US011840818B2

(12) United States Patent
Guo et al.

(10) Patent No.: US 11,840,818 B2
(45) Date of Patent: Dec. 12, 2023

(54) BIONIC INDUCTION TYPE BIOLOGICAL GROUTING DEVICE FOR UNIFORMLY REINFORCING FOUNDATION SOIL

(71) Applicant: Southwest Petroleum University, Chengdu (CN)

(72) Inventors: Liang Guo, Chengdu (CN); Baoquan Wang, Chengdu (CN); Jinlong Zhao, Chengdu (CN); Haixu Wen, Chengdu (CN); Min Zhang, Chengdu (CN); Yiqi Peng, Chengdu (CN); Jiaheng Xie, Chengdu (CN); Xingzhu Lin, Chengdu (CN); Ang Li, Chengdu (CN)

(73) Assignee: Southwest Petroleum University, Sichuan (CN)

( * ) Notice: Subject to any disclaimer, the term of this patent is extended or adjusted under 35 U.S.C. 154(b) by 0 days.

(21) Appl. No.: 18/098,711

(22) Filed: Jan. 19, 2023

(65) Prior Publication Data

US 2023/0340746 A1 Oct. 26, 2023

(30) Foreign Application Priority Data

Apr. 26, 2022 (CN) ..... 202210446166.0

(51) Int. Cl.
*E02D 3/12* (2006.01)

(52) U.S. Cl.
CPC ..... *E02D 3/126* (2013.01); *E02D 2250/003* (2013.01); *E02D 2600/10* (2013.01)

(58) Field of Classification Search
CPC ..... E02D 3/126; E02D 3/12
See application file for complete search history.

(56) References Cited

U.S. PATENT DOCUMENTS

2022/0251794 A1* 8/2022 Chen ..... E02D 3/12

FOREIGN PATENT DOCUMENTS

| | | |
|---|---|---|
| CN | 207974113 | 10/2018 |
| CN | 213952192 | 8/2021 |
| CN | 215907759 | 2/2022 |

* cited by examiner

*Primary Examiner* — Sean D Andrish
(74) *Attorney, Agent, or Firm* — SWOPE & YUY ANG IP LAW GROUP

(57) ABSTRACT

The present application discloses a bionic induction type biological grouting device for uniformly reinforcing foundation soil, comprising an operation table, a rotating shaft and a rotating disc, at least two grouting pipes are arranged in a wall of a spiral guide pipe, a plurality of grout outlet holes are formed in an inner wall of the spiral guide pipe, a plurality of sets of grout spraying holes are formed in an outer wall of the spiral guide pipe in a rotation direction of the spiral guide pipe, and a plurality of adjusting components for controlling opening and closing of each set of grout spraying holes are arranged in the spiral guide pipe, and the plurality of adjusting components are linked through a flexible shaft.

6 Claims, 2 Drawing Sheets

BIONIC INDUCTION TYPE BIOLOGICAL GROUTING DEVICE FOR UNIFORMLY REINFORCING FOUNDATION SOIL

TECHNICAL FIELD

The present application relates to the technical field of soil engineering reinforcement, and more particularly to a bionic induction type biological grouting device for uniformly reinforcing foundation soil.

BACKGROUND

In the process of civil engineering construction, it is often difficult to complete the engineering construction because of the soft nature of soil. In engineering, some technical measures are often used to reinforce soft foundation soil so as to meet the needs of engineering construction. Traditional methods for foundation reinforcement, such as mechanical rolling, changing the filling layer, chemical grouting or cement grouting, have outstanding effects but their drawbacks are obvious. It is difficult to reinforce the deep soil by using the mechanical rolling method, which has great potential safety hazards; the method of changing the filling layer consumes a lot of in multiple aspects such as manpower, material resources and financial resources, which is uneconomical; chemical reagents used in chemical grouting or cement grouting are not friendly to the environment and are difficult to diffuse in the whole soil. Compared with the traditional soil reinforcement methods, the green and environment-friendly ecological improved technology originated from the nature is more in line with the concept of sustainable development.

Bio-mineralization is a natural process, which widely exists in water environment, soil and rock. MICP technology realized by using this process provides a new idea for reinforcing soft soil in civil engineering construction. Under the background of ecological priority and green development, microbial-induced calcium carbonate precipitation (MICP) technology, which has a wide range of functions and little environmental pollution and rises in recent years, has been gradually applied to the field of reinforcement of bad soil. Compared with other traditional reinforcement methods, such as mechanical rolling, soil replacement and filling, chemical grouting and cement grouting etc., MICP is more environment-friendly and mild. MICP is that the non-erosive, low-pressure propagation of bacteria liquid and cementing liquid (generally the mixed solution of urea and calcium salt) needed for mineralization and injection into the soil layer. By using the widespread microbial mineralization in the nature, calcium carbonate crystal cemented sand particles are induced to be generated in the soil to improve the compactness of sand and the cementation between sand particles, thus improving the mechanical properties of soil layer. However, at present, the existing grouting device and grouting process cannot satisfy the global reinforcement of different types of soil layers, that is, the reinforcement effect of soil layers is usually dispersed, so uniform reinforcement of soil layers in the whole region cannot be achieved.

Therefore, how to prevent mineralized crystallized calcium carbonate from blocking the grouting hole by improving the grouting device and regulating the grout concentration, so as to realize the more effective use of MICP to realize the uniform reinforcement of the whole soil, has been a long-term common goal pursued by researchers and engineers in the field of foundation processing and improvement.

SUMMARY

The object of the present application is to provide a bionic induction type biological grouting device for uniformly reinforcing foundation soil, so as to solve the above problems.

The present application is implemented by the following technical solutions:

A bionic induction type biological grouting device for uniformly reinforcing foundation soil, the device comprising an operation table, a rotating shaft and a rotating disc located below the operation table, the rotating shaft is connected with the rotating disc after movably penetrating through the operation table, a spiral guide pipe is connected to bottom of the rotating disc, a guide head is arranged at end of the spiral guide pipe, at least two grouting pipes are arranged in a wall of the spiral guide pipe, a plurality of grout outlet holes communicated with the grouting pipes are formed in inner wall of the spiral guide pipe, a plurality of sets of grout spraying holes are arranged in outer wall of the spiral guide pipe at equal intervals in the rotation direction of the spiral guide pipe, a flexible shaft is further arranged in the spiral guide pipe, a plurality of adjusting components for controlling opening and closing of each set of grout spraying holes are arranged in the spiral guide pipe, and the plurality of adjusting components are linked through the flexible shaft. In the prior art, in addition to the problem that it is difficult to realize uniform grouting in the whole area when sand soil is reinforced by way of MICP, there will also be high activity of high-concentration bacteria liquid, which can rapidly hydrolyze urea to form mineralized crystals, resulting in accumulation of calcium carbonate crystals at the grout outlets and blockage of flowing channels, thus affecting the smooth infiltration of subsequent grout and seriously affecting the uniform reinforcement effect of the whole soil layer; in this regard, the inventor has developed a biological grouting device, the spiral guide pipe is used for conducting the sectional type grouting procedure in the rotary propelling process, so that grout is diffused in order in the coverage area of the spiral guide pipe in the soil layer and the radiation area of the plurality of sets of grout spraying holes, the diffusion range of the grout is enlarged, and meanwhile the situation that the grout spraying holes are blocked and the area grouting effect is affected is prevented.

During the specific operation, first, soil sample collection and analysis will be carried out on the target soil layer to determine the geological characteristics of the target soil layer, and then the corresponding grouting scheme will be specified; in this technical solution, a sharp guide head is arranged at the end of the spiral guide pipe, the rotating disc is driven to rotate by the rotating shaft, so that the spiral guide pipe is inserted into the target soil layer in a screwing manner, and the interior of the spiral guide pipe is hollow, a plurality of independent areas are formed in the spiral guide pipe through the plurality of adjusting components, and the plurality of independent areas can realize synchronous grouting or separate grouting; wherein the upper ends of the plurality of grouting pipes are respectively communicated with the liquid outlet end of the pump body, and the grout in the liquid storage tank is pumped to areas of different depth corresponding to the spiral guide pipe by means of pressure pumping, last, the opening and closing of the plurality of sets of grout spraying holes are realized by the control of the adjusting component, and finally the whole area coverage spraying of the grout is realized. It needs to be further noted that, the plurality of grout outlet holes communicated with the grouting pipes are arranged on the inner wall of the spiral guide pipe, that is, by controlling opening and closing of the grout outlet holes, the amount of grout injected in a specific independent area can be selected, so as to maintain the amount of the used grout acting in the target soil layer at a reasonable level and ensure its reinforcement effect.

The adjusting component comprises a partition plate and a bottom plate, a grouting cavity with both ends closed is formed between the partition plate and the bottom plate, the grouting cavity is communicated with outside through a set of grout spraying holes, the flexible shaft movably penetrates through the middle of the partition plate and the bottom plate, a gear disc matched with the transverse section of the spiral guide pipe is sleeved on the flexible shaft, a rotating cylinder is rotatably arranged in the grouting cavity, and an outer wall of the rotating cylinder is attached to the inner wall of the grouting cavity, a plurality of butt holes corresponding to the grout spraying holes are formed in inner wall of the rotating cylinder along a circumferential direction of the rotating cylinder, the grouting cavity is communicated with the grouting pipes through the grout outlet holes, a toothed gear is arranged on lower end surface of the gear disc, a conical toothed belt matched with the toothed gear is arranged on upper surface of the rotating cylinder, a plurality of arc-shaped positioning grooves are formed in the middle of upper surface of the gear disc, and the plurality of positioning grooves are on the same circumference, a spacing ring is arranged on outer wall of the flexible shaft, and a plurality of positioning blocks matched with the positioning grooves are arranged on lower end surface of the spacing ring.

Further, a grouting cavity with both ends closed as formed between the partition plate and the bottom plate is the above-mentioned independent area. The main function of the adjusting component is to control the opening and closing of each set of grout spraying holes, that is, to realize the grout's discharge or prevent the grout from being sprayed at a certain soil depth. When a plurality of grouting cavities in the spiral guide pipe are simultaneously grouted, a lifting unit is arranged on the ground for in the vertical downward direction the flexible shaft to move toward the end of the spiral guide pipe. Meanwhile, the spacing ring on the flexible shaft moves toward the direction close to the positioning groove until the positioning block located at the lower end surface of the spacing ring is inserted into the positioning groove, thereafter the flexible shaft is rotated again to rotate in situ in the spiral guide pipe. At this time, the flexible shaft and the gear disc form a whole, the gear disc can move circularly in the spiral guide pipe together with the flexible shaft. The gear disc achieves linked movement with the rotating cylinder through the cooperation of the conical gear and the conical toothed belt, until a plurality of butt holes are butt-joined with a plurality of grout spraying holes in a set, so that the grout in the grouting cavity is radiated outward along the radial direction of the spiral guide pipe through the spray holes.

A collar is arranged on the outer wall of the grouting cavity along the circumferential direction of the grouting cavity and the collar penetrates through the outer wall, and a plurality of spacing holes are formed on inner circumferential wall of the collar along the radial direction of the collar, a probe is arranged in each spacing hole, at least two cylinders are fixed on lower surface of the partition plate, a slider is arranged at output end of the cylinder, a follower cylinder is sleeved on the flexible shaft, an annular guide groove matched with the slider is formed on outer wall of upper section of the follower cylinder, and a plurality of spiral grooves corresponding to the probes are arranged on outer circumferential wall of the follower cylinder along the circumferential direction of the follower cylinder, the transverse section of the spiral groove is trapezoidal, a flexible connector coaxial with the probe is arranged at inner end of the probe, a displacement sensor is arranged in the probe, and the displacement sensor is electrically connected with the cylinder through a controller, a plurality of clamping grooves are formed on the outer circumferential wall of the flexible shaft along a circumferential direction of the flexible shaft, clamping blocks matched with the clamping grooves are arranged on inner circumferential wall of the spacing ring, a bearing is arranged on lower end surface of the follower cylinder, the inner ring of the bearing is connected with upper end surface of the spacing ring through a connecting rod; in an initial state, the end of each flexible connector is respectively placed at the groove bottom of the corresponding spiral groove. In addition, a collar is arranged on the grouting cavity, a plurality of probes matched with the follower cylinder are arranged in the collar, the follower cylinder can be driven to move vertically downward by the driving of the two inverted cylinders, and the inner end of the probe is in contact with the bottom of the spiral groove through a flexible connector, so that the follower cylinder can drive the probe to move out of the spacing hole after displacement is generated, and a displacement sensor is arranged in the probe, the position of the probe is detected by the displacement sensor, the soil layer characteristics corresponding to each grouting cavity can be determined; the details are as follows: the soil layer corresponding to the probe with a large displacement is soft, and there are many cracks in the soil, so it is necessary to reinforce this area; however, the soil layer corresponding to the probe with a small displacement is hard, and there are few cracks in the soil, so it can be considered to cancel the reinforcing operation in this area.

After the displacement data of the probes in different grouting cavities are transmitted to the controller, through analysis and calculation of the controller, a threshold value required for reinforcement is preset according to the soil data obtained from analysis and sampling. If the threshold value is exceeded, the controller generates a control command, and the output end of the driving cylinder drives the follower cylinder to continue to move downward, a flexible connector is arranged in the inner end of the probe, it can be ensured that the inner end of the flexible connector can still move along the spiral groove for a certain distance under the premise that the probe is blocked by the soil, which distance is enough for the positioning block to be inserted into the positioning groove, a plurality of clamping grooves are formed on the outer circumferential wall of the flexible shaft, clamping blocks matched with the clamping grooves are arranged on the inner circumferential wall of the spacing ring, a bearing is arranged on the lower end surface of the follower cylinder, the inner ring of the bearing is connected with the upper end surface of the spacing ring through a connecting rod, so that the spacing ring can move along the axis of the flexible shaft for a certain distance on the premise of performing synchronous rotation with the flexible shaft, and this distance moved along the axis of the flexible shaft is realized by the movement of the follower cylinder.

Under the above circumstance, after the probe tests in different grouting cavities, the corresponding grouting strategy can be made at the first time for each grouting cavity, that is, when the soil area corresponding to the grouting cavity needs to be reinforced and grouted, the cylinder drives the follower cylinder and the spacing ring to move synchronously, ensuring that the positioning block is inserted into the positioning groove after the displacement data of the probe is collected and calculated, so that the flexible shaft, the gear disc and the rotating cylinder form a whole, and a plurality of grout spraying holes are opened while the flexible shaft rotates, and, the grout spraying holes are closed when the flexible shaft is rotated reversely after the grouting is finished; on the contrary, when grouting and reinforcing are not required, the displacement of the follower cylinder is only for the normal extension of the probe. The plurality of spraying holes correspond to the plurality of grouting cavities, and the plurality of grouting cavities correspond to the plurality of collars, the plurality of probes in the collars are similar to the antennae of arthropods according to bionics theory, and will produce quick reactions when they sense obstacles or natural enemies, such as direction turning, spraying irritating gas or liquid, etc., to solve the current situation; this solution is implemented based on this type of manner, that is, the degree of softness of the soil layer is determined by detecting the displacement of the probe, so as to carry out the corresponding grouting process, thus an accurate reinforcement of different areas of the soil layer is achieved.

An electromagnetic valve is arranged in each of the grout outlet holes. As a preference, an electromagnetic valve is arranged in each grout outlet hole, and the electromagnetic valve can control the flow rate of the grout in real time, so as to reduce the amount of the grout used after the grouting strategy is determined.

A motor is further comprised, an output end of the motor is connected with the flexible shaft, and the motor is electrically connected with the controller. In addition, the motor is arranged on the ground as the power component of the flexible shaft, and connected with the controller, so that action executions of the motor and the cylinder are in the same closed control loop, thus the intelligent selective grouting in the whole area is realized, the grouting strategy is optimized, and the amount of grout used is reduced to the maximum extent.

The flexible connector comprises a linkage rod and a spring, a guide rod coaxial with the linkage rod is arranged at outer end of the linkage rod, the spring is sleeved on the guide rod, and a blind hole is arranged at inner end of the probe, the guide rod is partially placed in the blind hole, one end of the spring is connected with bottom of the blind hole, the other end of the spring is connected with outer end surface of the linkage rod; in an initial state, the inner end of the linkage rod is placed at groove bottom of the corresponding spiral groove. In addition, when the displacement of the probe in the same grouting cavity reaches the preset threshold, the cylinder will drive the follower cylinder to move downward continuously, the probe may be blocked in the process of moving continuously, so it is easy to cause damage to the probe by pushing the probe to move continuously. For this reason, in this solution, the flexible connector is provided, the probability of hard damage to the probe can be avoided by using the flexible deformation of the spring and the linear movement of the guide rod in the blind hole. It should be pointed out that in the initial state, the inner end of the linkage rod is placed at the groove bottom of the corresponding spiral groove, wherein the transverse section of the spiral groove is trapezoidal, and a follower block matched with the transverse section of the spiral groove is arranged on the inner end of the linkage rod, so that it can be ensured that the probe performs corresponding telescopic movement along with the follower cylinder.

A snap ring is rotatably arranged on the annular guide groove, an annular groove coaxial with the follower cylinder is formed on the upper surface of the snap ring, the longitudinal section of the annular groove is T-shaped, and the slider is matched with the annular groove and slidably arranged in the annular groove. In addition, a snap ring is rotatably arranged on the annular guide groove, an annular groove coaxial with the follower cylinder is formed on the upper surface of the snap ring, the longitudinal section of the annular groove is T-shaped, and the slider is matched with the annular groove and slidably arranged in the annular groove, such that after the positioning block is abutted with the positioning groove, the follower cylinder is connected as a whole with the gear disc through the spacing ring and the positioning block, the motor is started and it is ensured that the rotation direction of the motor is opposite to that of the spiral groove, the follower cylinder will move with the flexible shaft in the direction opposite to the rotation direction of the spiral groove, the probe starts to move along the spacing hole towards the direction close to the follower cylinder while the outward movement of the probe stops, thus automatic retraction is realized.

A buffer ring is connected to lower end surface of the rotating cylinder, and inner diameter of the buffer ring increases from top to bottom along the axis of the rotating cylinder. As a preference, in the grouting cavity, movable sealing rings are arranged on both outer circumferential wall of the gear disc and outer circumferential wall of the rotating cylinder, and the grout outlet hole communicates with the lower part of the grouting cavity, so that the grout in the grouting pipe is stored in the area between the lower surface of the gear disc and the upper surface of the bottom plate after being injected into the grouting cavity. By connecting a buffer ring to the lower end surface of the rotating cylinder, and the inner diameter of the buffer ring increases from top to bottom along the axis of the rotating cylinder, the gradually-changed inner diameter of the buffer ring can calm the drastic fluctuation of the grout to a certain extent, which can prevent the grout injected under pressure from causing excessive agitation in the storage area, thus the amount of the grout injected through the grout spraying hole in a unit time is ensured, and the requirement of realizing global or local grouting in a short time is met.

A base is rotatably arranged on outer circumferential wall of the rotating disc, and a plurality of claws are uniformly arranged on outer wall of the base. In addition, a base is used to support the rotating disc, the operation table and the rotating shaft, and it can be applied to the target soil with different landforms through a plurality of claws on the outer wall of the base; when in use, the plurality of claws can be inserted into the surface layer of the soil from a plurality of angles to ensure the smooth downward movement of the spiral guide pipe.

Compared with the prior art, the present application has the following advantages and beneficial effects:

1. In the present application, the spiral guide pipe is used for conducting the sectional type grouting procedure in the rotary propelling process, so that grout is diffused in order in the coverage area of the spiral guide pipe in the soil layer and the radiation area of the plurality of sets of grout spraying holes, the diffusion range of the grout is enlarged, and meanwhile the situation that the grout spraying holes are blocked and the area grouting effect is affected is prevented;

2. In the present application, the flexible shaft can form a whole with the gear disc, and the gear disc can move circularly in the spiral guide pipe together with the flexible shaft, the gear disc achieves the linked movement with the rotating cylinder through the cooperation of the conical gear and the conical toothed belt, until a plurality of butt holes are butt-jointed with a plurality of grout spraying holes in a set, so that the grout in the grouting cavity is radiated and sprayed out along the radial direction of the spiral guide pipe through the grout spraying holes;
3. In the present application, the follower cylinder is connected as a whole with the gear disc through the spacing ring and the positioning block, the motor is started and it is ensured that the rotation direction of the motor is opposite to that of the spiral groove, the follower cylinder will move with the flexible shaft in the direction opposite to the rotation direction of the spiral groove, the probe starts to move along the spacing hole towards the direction close to the follower cylinder while the outward movement of the probe stops, thus automatic retraction is realized.

BRIEF DESCRIPTION OF THE DRAWINGS

The drawings illustrated here are used to provide a further understanding of the embodiments of the present application, and form a part of the present application, but do not constitute a limitation on the embodiments of the present application. In the attached drawings.

The reference signs represent as follows: 1—Operation table, 2—Rotating shaft, 3—Rotating disc, 4—Base, 5—Spiral guide pipe, 6—Claw, 7—Motor, 8—Flexible shaft, 9—Partition plate, 10—Cylinder, 11—Snap ring, 12—Spacing hole, 13—Gear disc, 14—Rotating cylinder, 15—Grout outlet hole, 16—Bottom plate, 17—Grouting pipe, 18—Annular groove, 19—Slider, 20—Follower cylinder, 21—Spiral groove, 22—Probe, 23—Spring, 24—Linkage rod, 25—Spacing ring, 26—Positioning block, 27—Positioning groove, 28—Butt hole, 29—Buffer ring, 30—Collar, 31—Grout spraying hole.

DETAILED DESCRIPTION OF THE EMBODIMENTS

In order to make the purposes, technical solutions and advantages of the present application be clearer, the present application will be described in further detail below with reference to embodiments and drawings. The illustrative embodiments of the present application and their descriptions are only used to explain the present application, but not to limit the present application. It should be noted that the present application is already in the actual development and use stage.

Embodiment 1

Figure 1:
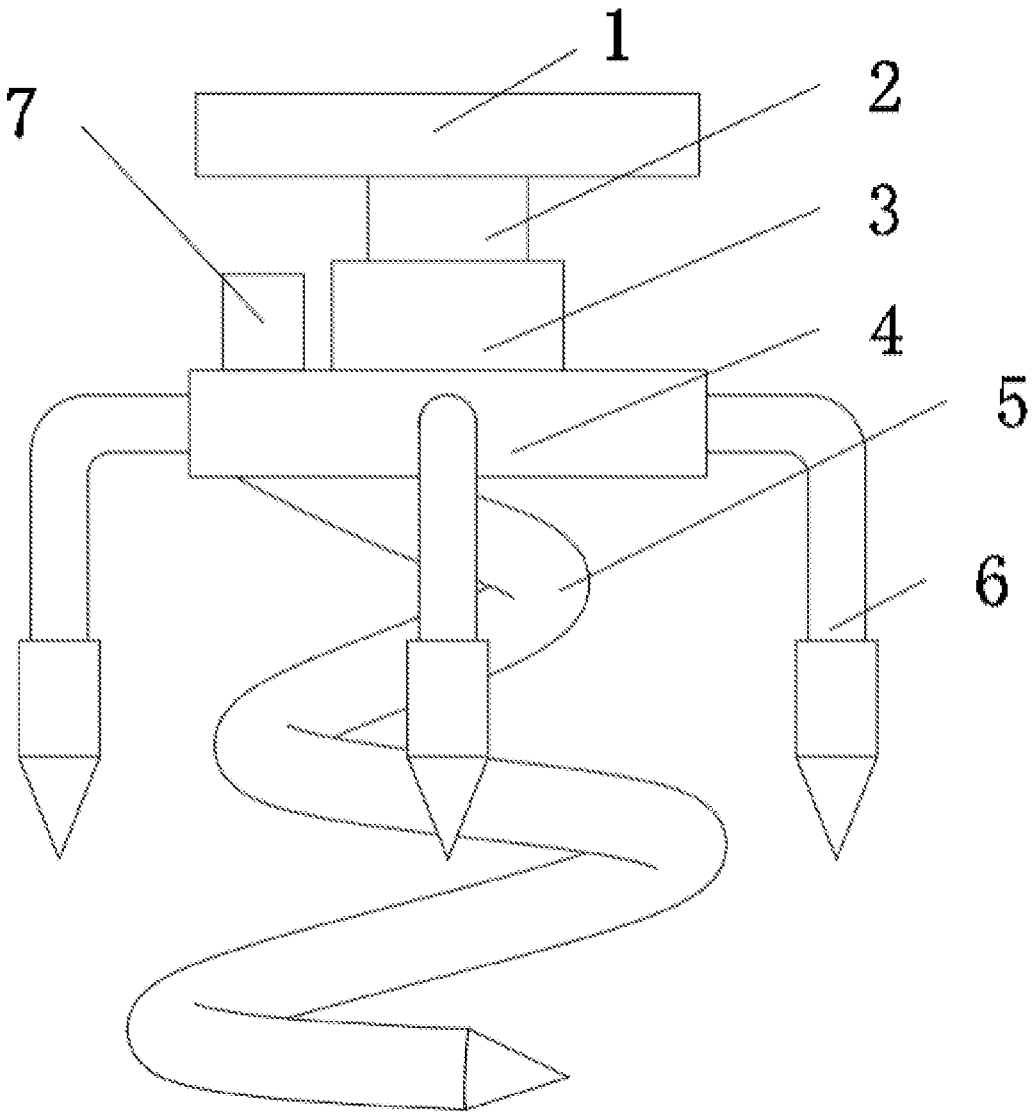
FIG. 1 is a schematic structural diagram of the present application.
Figure 2:
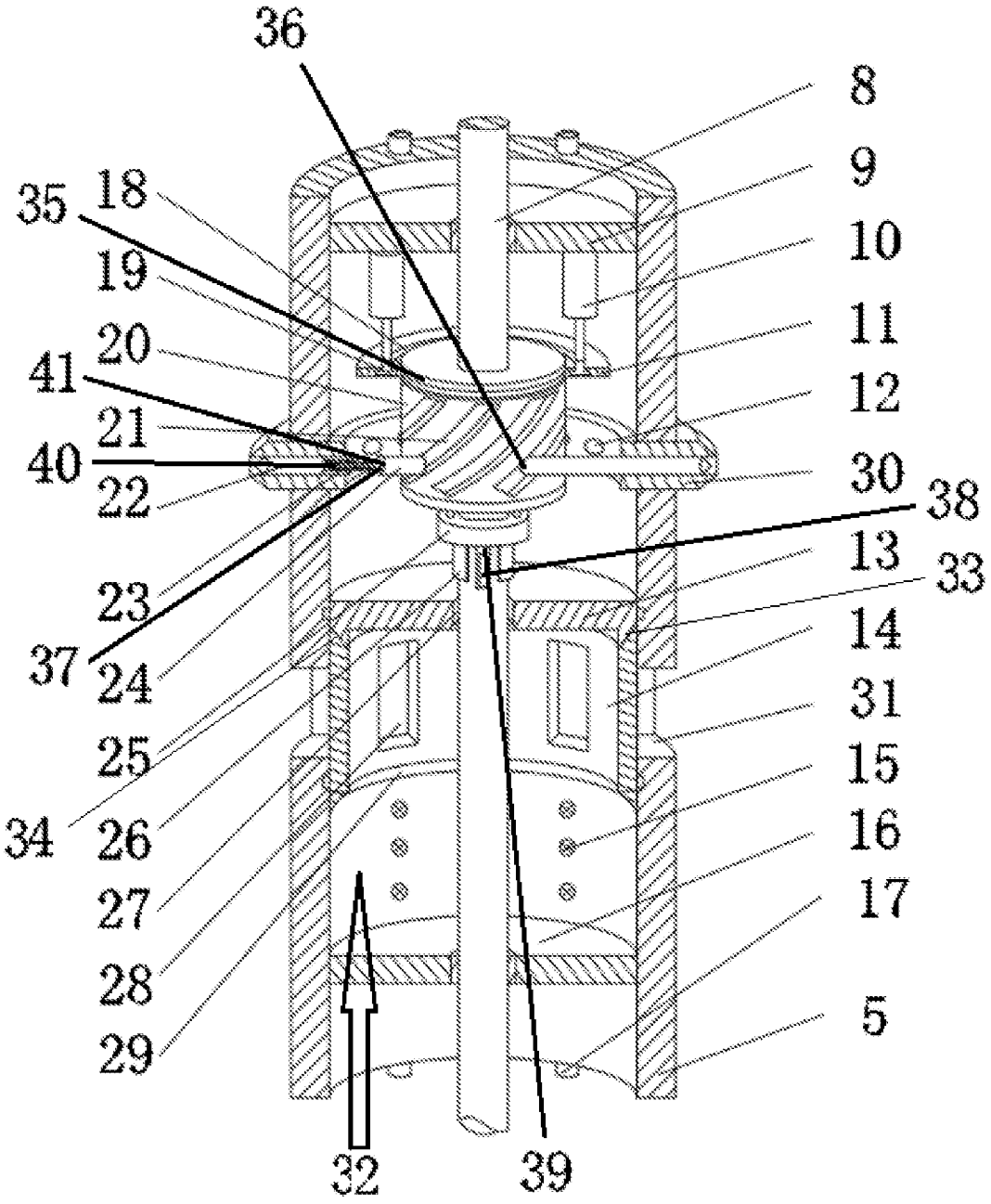
FIG. 2 is a longitudinal sectional view of the grouting cavity.

As shown in FIG. 1 to FIG. 2, this embodiment comprises an operation table 1, a rotating shaft 2 and a rotating disc 3 located below the operation table 1, the rotating shaft 2 is connected with the rotating disc 3 after movably penetrating through the operation table 1, a spiral guide pipe 5 is connected to the bottom of the rotating disc 3, a guide head is arranged at the end of the spiral guide pipe 5, at least two grouting pipes 17 are arranged in the wall of the spiral guide pipe 5, a plurality of grout outlet holes 15 communicated with the grouting pipes 17 are formed in the inner wall of the spiral guide pipe 5, a plurality of sets of grout spraying holes 31 are arranged in the outer wall of the spiral guide pipe 5 at equal intervals in the rotation direction of the spiral guide pipe 5, a flexible shaft 8 is further arranged in the spiral guide pipe 5, a plurality of adjusting components used for controlling opening and closing of each set of grout spraying holes 31 are arranged in the spiral guide pipe 5, and the plurality of adjusting components are linked through the flexible shaft 8.

The adjusting component for opening and closing the plurality of sets of grout spraying holes comprises a partition plate 9 and a bottom plate 16, a grouting cavity with both ends closed is formed between the partition plate 9 and the bottom plate 16, the grouting cavity is communicated with the outside through a set of grout spraying holes 31, the flexible shaft 8 movably penetrates through the middle of the partition plate 9 and the bottom plate 16, a gear disc 13 matched with the transverse section of the spiral guide pipe 5 is sleeved on the flexible shaft 8, a rotating cylinder 14 is rotatably arranged in the grouting cavity, and the outer wall of the rotating cylinder 14 is attached to the inner wall of the grouting cavity, a plurality of butt holes 28 corresponding to the grout spraying holes 31 are formed on the inner wall of the rotating cylinder 14 along a circumferential direction of the rotating cylinder 14, the grouting cavity is communicated with the grouting pipes 17 through the grout outlet holes 15, a toothed gear is arranged on the lower end surface of the gear disc 13, a conical toothed belt matched with the toothed gear is arranged on the upper surface of the rotating cylinder, a plurality of arc-shaped positioning grooves 27 are formed in the central part of the upper surface of the gear disc 13, and the plurality of positioning grooves 27 are on the same circumference, a spacing ring 25 is arranged on the outer wall of the flexible shaft 8, and a plurality of positioning blocks 26 matched with the positioning grooves 27 are arranged on the lower end surface of the spacing ring 25.

During the specific operation, first, soil sample collection and analysis will be carried out on the target soil layer to determine the geological characteristics of the target soil layer, and then the corresponding grouting scheme will be specified; in this technical solution, a sharp guide head is arranged at the end of the spiral guide pipe 5, the rotating disc 3 is driven to rotate by the rotating shaft 2, so that the spiral guide pipe 5 is inserted into the target soil layer in a screwing manner, and the interior of the spiral guide pipe 5 is hollow, a plurality of independent areas are formed in the spiral guide pipe 5 through the plurality of adjusting components, and the plurality of independent areas can realize synchronous grouting or separate grouting; wherein the upper ends of the plurality of grouting pipes 17 are respectively communicated with the liquid outlet end of the pump body, and the grout in the liquid storage tank is pumped to areas of different depth corresponding to the spiral guide pipe 5 by means of pressure pumping, last, the opening and closing of the plurality of sets of grout spraying holes 31 are realized by the control of the adjusting component, and finally the whole area coverage spraying of the grout is realized. It needs to be further noted that, the plurality of grout outlet holes 15 communicated with the grouting pipes 17 are arranged on the inner wall of the spiral guide pipe 5, that is, by controlling opening and closing of the grout outlet holes 15, the amount of grout injected in a specific independent area can be selected, so as to maintain the amount of the used grout acting in the target soil layer at a reasonable level and ensure its reinforcement effect.

A grouting cavity with both ends closed as formed between the partition plate 9 and the bottom plate 16 is the above-mentioned independent area. The main function of the adjusting component is to control the opening and closing of each set of grout spraying holes 31, that is, to realize the grout's discharge or prevent the grout from being sprayed at a certain soil depth. When a plurality of grouting cavities in the spiral guide pipe 5 are simultaneously grouted, a lifting unit is arranged on the ground for in the vertical downward direction the flexible shaft 8 to move toward the end of the spiral guide pipe 5. Meanwhile, the spacing ring 25 on the flexible shaft 8 moves toward the direction close to the positioning groove 27 until the positioning block 26 located at the lower end surface of the spacing ring 25 is inserted into the positioning groove 27, thereafter the flexible shaft 8 is rotated again to rotate in situ in the spiral guide pipe 5. At this time, the flexible shaft 8 and the gear disc 13 form a whole, the gear disc 13 can move circularly in the spiral guide pipe 5 together with the flexible shaft 8. The gear disc 13 achieves linked movement with the rotating cylinder 14 through the cooperation of the conical gear and the conical toothed belt, until a plurality of butt holes 28 are butt-joined with a plurality of grout spraying holes 31 in a set, so that the grout in the grouting cavity is radiated outward along the radial direction of the spiral guide pipe 5 through the spray holes 31.

As a preference, a base 4 is used to support the rotating disc 3, the operation table 1 and the rotating shaft 2, and it can be applied to the target soil with different landforms through a plurality of claws 6 on the outer wall of the base 4; when in use, the plurality of claws 6 can be inserted into the surface layer of the soil from a plurality of angles to ensure the smooth downward movement of the spiral guide pipe 5.

As a preference, in the grouting cavity, movable sealing rings are arranged on both the outer circumferential wall of the gear disc 13 and the outer circumferential wall of the rotating cylinder 4, and the grout outlet hole 15 communicates with the lower part of the grouting cavity, so that the grout in the grouting pipe 17 is stored in the area between the lower surface of the gear disc 13 and the upper surface of the bottom plate 16 after being injected into the grouting cavity. By connecting a buffer ring 29 to the lower end surface of the rotating cylinder 14, and the inner diameter of the buffer ring 29 increases from top to bottom along the axis of the rotating cylinder 14, the gradually-changed inner diameter of the buffer ring 29 can calm the drastic fluctuation of the grout to a certain extent, which can prevent the grout injected under pressure from causing excessive agitation in the storage area, thus the amount of the grout injected through the grout spraying hole 31 in a unit time is ensured, and the requirement of realizing global or local grouting in a short time is met.

As a preference, an electromagnetic valve is arranged in each grout outlet hole 15, and the electromagnetic valve can control the flow rate of the grout in real time, so as to reduce the amount of the grout used after the grouting strategy is determined.

Embodiment 2

As shown in FIG. 1 to FIG. 2, based on Embodiment 1, in this embodiment, a collar 30 is arranged to penetrate through on the outer wall of the grouting cavity along the circumferential direction of the grouting cavity, and a plurality of spacing holes 12 are formed on the inner circumferential wall of the collar 30 along the radial direction of the collar 30, a probe 22 is arranged in each spacing hole 12, at least two cylinders 10 are fixed on the lower surface of the partition plate 9, a slider 19 is arranged at the output end of the cylinder 10, a follower cylinder 20 is sleeved on the flexible shaft 8, an annular guide groove matched with the slider 19 is formed on the outer wall of the upper section of the follower cylinder 20, and a plurality of spiral grooves 21 corresponding to the probes 22 are arranged on the outer circumferential wall of the follower cylinder 20 along the circumferential direction of the follower cylinder 20, the transverse section of the spiral groove 21 is trapezoidal, a flexible connector coaxial with the probe 22 is arranged at the end of the inner end of the probe 22, a displacement sensor is arranged in the probe 22, and the displacement sensor is electrically connected with the cylinder 10 through a controller, a plurality of clamping grooves are formed on the outer circumferential wall of the flexible shaft 8 along the circumferential direction of the flexible shaft 8, clamping blocks matched with the clamping grooves are arranged on the inner circumferential wall of the spacing ring 25, a bearing is arranged on the lower end surface of the follower cylinder 20, the inner ring of the bearing is connected with the upper end surface of the spacing ring 25 through a connecting rod; in an initial state, the end of each flexible connector is respectively placed at the groove bottom of the corresponding spiral groove 21.

A collar 30 is arranged on the grouting cavity, a plurality of probes 22 matched with the follower cylinder 20 are arranged in the collar 30, the follower cylinder 20 can be driven to move vertically downward by the driving of the two inverted cylinders 10, and the inner end of the probe 22 is in contact with the bottom of the spiral groove 21 through a flexible connector, so that the follower cylinder 20 can drive the probe 22 to move out of the spacing hole 12 after displacement is generated, and a displacement sensor is arranged in the probe 22, the position of the probe 22 is detected by the displacement sensor, the soil layer characteristics corresponding to each grouting cavity can be determined; the details are as follows: the soil layer corresponding to the probe 22 with a large displacement is soft, and there are many cracks in the soil, so it is necessary to reinforce this area; however, the soil layer corresponding to the probe 22 with a small displacement is hard, and there are few cracks in the soil, so it can be considered to cancel the reinforcing operation in this area.

After the displacement data of the probes 22 in different grouting cavities are transmitted to the controller, through analysis and calculation of the controller, a threshold value required for reinforcement is preset according to the soil data obtained from analysis and sampling. If the threshold value is exceeded, the controller generates a control command, and the output end of the driving cylinder 10 drives the follower cylinder 20 to continue to move downward, a flexible connector is arranged in the inner end of the probe 22, it can be ensured that the inner end of the flexible connector can still move along the spiral groove 21 for a certain distance under the premise that the probe 22 is blocked by the soil, which distance is enough for the positioning block 26 to be inserted into the positioning groove 27, a plurality of clamping grooves are formed on the outer circumferential wall of the flexible shaft 8, clamping blocks matched with the clamping grooves are arranged on the inner circumferential wall of the spacing ring 25, a bearing is arranged on the lower end surface of the follower cylinder 20, the inner ring of the bearing is connected with the upper end surface of the spacing ring 25 through a connecting rod, so that the spacing ring 25 can move along the axis of the flexible shaft 8 for a certain distance on the premise of performing synchronous rotation with the flexible shaft 8, and this distance moved along the axis of the flexible shaft 8 is realized by the movement of the follower cylinder 20.

Under the above circumstance, after the probe 22 tests in different grouting cavities, the corresponding grouting strategy can be made at the first time for each grouting cavity, that is, when the soil area corresponding to the grouting cavity needs to be reinforced and grouted, the cylinder 10 drives the follower cylinder 20 and the spacing ring 25 to move synchronously, ensuring that the positioning block 26 is inserted into the positioning groove 27 after the displacement data of the probe 22 is collected and calculated, so that the flexible shaft 8, the gear disc 13 and the rotating cylinder 14 form a whole, and a plurality of grout spraying holes 31 are opened while the flexible shaft 8 rotates, and, the grout spraying holes 31 are closed when the flexible shaft 8 is rotated reversely after the grouting is finished; on the contrary, when grouting and reinforcing are not required, the displacement of the follower cylinder 20 is only for the normal extension of the probe 22.

This embodiment further includes a motor 7, the output end of the motor 7 is connected with the flexible shaft 8, and the motor 7 is electrically connected with the controller. The motor 7 is arranged on the ground as the power component of the flexible shaft 8, and connected with the controller, so that action executions of the motor 7 and the cylinder 10 are in the same closed control loop, thus the intelligent selective grouting in the whole area is realized, the grouting strategy is optimized, and the amount of grout used is reduced to the maximum extent.

The flexible connector in this embodiment includes a linkage rod 24 and a spring 23, a guide rod coaxial with the linkage rod is arranged at the outer end of the linkage rod 24, the spring 23 is sleeved on the guide rod, and a blind hole is arranged at the inner end of the probe 22, the guide rod is partially placed in the blind hole, one end of the spring 23 is connected with the bottom of the blind hole, the other end of the spring 23 is connected with the outer end surface of the linkage rod 24; in an initial state, the inner end of the linkage rod 24 is placed at the groove bottom of the corresponding spiral groove 21.

When the displacement of the probe 22 in the same grouting cavity reaches the preset threshold, the cylinder 10 will drive the follower cylinder 20 to move downward continuously, the probe 22 may be blocked in the process of moving continuously, so it is easy to cause damage to the probe by pushing the probe 22 to move continuously. For this reason, in this scheme, the flexible connector is arranged, the probability of hard damage to the probe 22 can be avoided by using the flexible deformation of the spring 23 and the linear movement of the guide rod in the blind hole.

It should be pointed out that in the initial state, the inner end of the linkage rod 24 is placed at the groove bottom of the corresponding spiral groove 21, wherein the transverse section of the spiral groove 21 is trapezoidal, and a follower block matched with the transverse section of the spiral groove 21 is arranged on the inner end of the linkage rod 24, so that it can be ensured that the probe 22 performs corresponding telescopic movement along with the follower cylinder 20.

Embodiment 3

As shown in FIG. 1 to FIG. 2, based on Embodiment 2, in this embodiment, a snap ring 11 is rotatably arranged on the annular guide groove, an annular groove 18 coaxial with the follower cylinder 20 is formed on the upper surface of the snap ring 11, the longitudinal section of the annular groove 18 is T-shaped, and the slider 19 is matched with the annular groove 18 and slidably arranged in the annular groove 18.

The above described specific embodiments have further explained the purposes, technical solutions and beneficial effects of the present application in detail. It should be understood that the above described embodiments are only specific embodiments of the present application, and are not intended to limit the protection scope of the present application. Any modifications, equivalent substitutions, improvements, etc. made within the spirit and principle of the present application should be included in the protection scope of the present application.

What is claimed is:

1. A bionic induction type biological grouting device for uniformly reinforcing foundation soil, comprising an operation table (1), a rotating shaft (2) and a rotating disc (3) located below the operation table (1), the rotating shaft (2) being connected with the rotating disc (3) after movably penetrating through the operation table (1), wherein a spiral guide pipe (5) is connected to a bottom of the rotating disc (3), a guide head is arranged at an end of the spiral guide pipe (5), at least two grouting pipes (17) are arranged in a wall of the spiral guide pipe (5), a plurality of grout outlet holes (15) communicated with the grouting pipes (17) are formed in an inner wall of the spiral guide pipe (5), a plurality of sets of grout spraying holes (31) are formed in an outer wall of the spiral guide pipe (5) at equal intervals in a rotation direction of the spiral guide pipe (5), a flexible shaft (8) is further arranged in the spiral guide pipe (5), a plurality of adjusting components for controlling opening and closing of each set of grout spraying holes (31) are arranged in the spiral guide pipe (5), and the plurality of adjusting components are linked through the flexible shaft (8);

the plurality of adjusting components comprise a partition plate (9) and a bottom plate (16), a grouting cavity (32) with both ends closed is formed between the partition plate (9) and the bottom plate (16), the grouting cavity is communicated with outside through one of the plurality of sets of grout spraying holes (31), the flexible shaft (8) movably penetrates through a middle of the partition plate (9) and the bottom plate (16), a gear disc (13) matched with a transverse section of the spiral guide pipe (5) is sleeved on the flexible shaft (8), a rotating cylinder (14) is rotatably arranged in the grouting cavity (32), and an outer wall of the rotating cylinder (14) is attached to an inner wall of the grouting cavity (32), a plurality of butt holes (28) corresponding to one of the plurality of sets of grout spraying holes (31) are formed in an inner wall of the rotating cylinder (14) along a circumferential direction of the rotating cylinder (14), the grouting cavity is communicated with the grouting pipes (17) through the grout outlet holes (15), a toothed gear (33) is arranged on a lower end surface of the gear disc (13), a conical toothed belt (34) matched with the toothed gear is arranged on an upper surface of the rotating cylinder (14), a plurality of arc-shaped positioning grooves (27) are formed in a middle of an upper surface of the gear disc (13), and the plurality of positioning grooves (27) are on a same circumference, a spacing ring (25) is arranged on an outer wall of the flexible shaft (8), and a plurality of positioning blocks (26) matched with the positioning grooves (27) are arranged on a lower end surface of the spacing ring (25);

a collar (30) is arranged on the outer wall of the grouting cavity along a circumferential direction of the grouting cavity and the collar penetrates through an outer wall, and a plurality of spacing holes (12) are formed on an inner circumferential wall of the collar (30) along a radial direction of the collar (30), a probe (22) is arranged in each spacing hole (12), at least two cylinders (10) are fixed on a lower surface of the partition plate (9), a slider (19) is arranged at an output end of each cylinder (10), a follower cylinder (20) is sleeved on the flexible shaft (8), an annular guide groove (35) matched with the slider (19) is formed on an outer wall of an upper section of the follower cylinder (20), and a plurality of spiral grooves (21) corresponding to the probes (22) are formed on an outer circumferential wall of the follower cylinder (20) along a circumferential direction of the follower cylinder (20), a transverse section of each spiral groove (21) is trapezoidal, a flexible connector (36) coaxial with the probe (22) is arranged at an inner end of the probe (22), a displacement sensor (37) is arranged in the probe (22), and a plurality of clamping grooves (38) are formed on an outer circumferential wall of the flexible shaft (8) along a circumferential direction of the flexible shaft (8), and clamping blocks (39) matched with the clamping grooves are arranged on an inner circumferential wall of the spacing ring (25); in an initial state, the end of each flexible connector is respectively placed at a groove bottom of the corresponding spiral groove (21).

2. The bionic induction type biological grouting device for uniformly reinforcing foundation soil according to claim 1, further comprising a motor (7), an output end of the motor is connected with the flexible shaft (8), and the motor (7) is electrically connected with the controller.

3. The bionic induction type biological grouting device for uniformly reinforcing foundation soil according to claim 2, wherein a snap ring (11) is rotatably arranged on the annular guide groove, an annular groove (18) coaxial with the follower cylinder (20) is formed on an upper surface of the snap ring (11), a longitudinal section of the annular groove (18) is T-shaped, and the slider (19) is matched with the annular groove (18) and slidably arranged in the annular groove (18).

4. The bionic induction type biological grouting device for uniformly reinforcing foundation soil according to claim 1, wherein the flexible connector comprises a linkage rod (24) and a spring (23), a guide rod coaxial with the linkage rod is arranged at an outer end of the linkage rod (24), the spring (23) is sleeved on the guide rod (40), and a blind hole (41) is formed at an inner end of the probe (22), the guide rod is partially placed in the blind hole, one end of the spring (23) is connected with a bottom of the blind hole, another end of the spring (23) is connected with an outer end surface of the linkage rod (24); in an initial state, an inner end of the linkage rod (24) is placed at the groove bottom of the corresponding spiral groove (21).

5. The bionic induction type biological grouting device for uniformly reinforcing foundation soil according to claim 1, wherein a buffer ring (29) is connected to a lower end surface of the rotating cylinder (14), and an inner diameter of the buffer ring (29) increases from top to bottom along an axis of the rotating cylinder (14).

6. The bionic induction type biological grouting device for uniformly reinforcing foundation soil according to any one of claims 1 and 2-5, wherein a base (4) is rotatably arranged on an outer circumferential wall of the rotating disc (3), and a plurality of claws (6) are uniformly arranged on an outer wall of the base (4).

* * * * *